US009159543B2

(12) United States Patent
Kalinitchenko

(10) Patent No.: US 9,159,543 B2
(45) Date of Patent: Oct. 13, 2015

(54) ION DEFLECTOR FOR A MASS SPECTROMETER

(71) Applicant: Bruker Chemical Analysis BV, Wormer (NL)

(72) Inventor: Iouri Kalinitchenko, Berwick (AU)

( * ) Notice: Subject to any disclaimer, the term of this patent is extended or adjusted under 35 U.S.C. 154(b) by 0 days.

(21) Appl. No.: 14/383,265

(22) PCT Filed: Mar. 20, 2013

(86) PCT No.: PCT/AU2013/000276
§ 371 (c)(1),
(2) Date: Sep. 5, 2014

(87) PCT Pub. No.: WO2013/138852
PCT Pub. Date: Sep. 26, 2013

(65) Prior Publication Data

US 2015/0060687 A1 Mar. 5, 2015

(30) Foreign Application Priority Data

Mar. 20, 2012 (AU) ..... 2012901118

(51) Int. Cl.
*H01J 49/00* (2006.01)
*H01J 49/22* (2006.01)
*H01J 49/06* (2006.01)

(52) U.S. Cl.
CPC ..... *H01J 49/22* (2013.01); *H01J 49/061* (2013.01)

(58) Field of Classification Search
CPC ..... H01J 49/067; H01J 49/061; H01J 49/06; H01J 49/22
USPC ..... 250/281, 282, 297, 396 R
See application file for complete search history.

(56) References Cited

U.S. PATENT DOCUMENTS 6,614,021 B1 * 9/2003 Kalinitchenko ..... 250/294
2010/0301227 A1 * 12/2010 Muntean ..... 250/396 R

* cited by examiner

*Primary Examiner* — Michael Maskell
(74) *Attorney, Agent, or Firm* — Robic, LLP

(57) ABSTRACT

There is provided an ion deflector for use with a mass spectrometer for directing a flow of ions between two distinct axes of travel. The ion deflector includes an electric field inducer arranged so as to establish at least one electrostatic field capable of deflecting ions travelling substantially along a first intended path of travel so as to travel substantially along a second intended path of travel.

20 Claims, 16 Drawing Sheets

ION DEFLECTOR FOR A MASS SPECTROMETER

FIELD OF THE INVENTION

The present invention concerns improvements in or relating to mass spectrometry. More particularly, in one aspect, the invention relates to improvements to an ion deflector arrangement for use with mass spectrometry apparatus.

BACKGROUND OF THE INVENTION

In this specification, where a document, act or item of knowledge is referred to or discussed, this reference or discussion is not an admission that the document, act or item of knowledge or any combination thereof was at the priority date part of common general knowledge, or known to be relevant to an attempt to solve any problem with which this specification is concerned.

Mass spectrometers are specialist devices used to measure or analyse the mass-to-charge ratio of charged particles for the determination of the elemental or molecular composition of a sample or molecule.

A number of different techniques are used for such measurement purposes. One form of mass spectrometry involves the use of an inductively coupled plasma (ICP) for generating a plasma. In this form, the plasma vaporises and ionizes the sample so that ions from the sample can be introduced to a mass spectrometer for measurement/analysis (spectrometric analysis).

As the mass spectrometer requires a vacuum in which to operate, the extraction and transfer of ions from the plasma involves a fraction of the ions formed by the plasma passing through an aperture of approximately 1 mm in size provided in a sampler, and then through an aperture of approximately 0.5 mm in size provided in a skimmer (typically referred to as sampler and skimmer cones respectively).

Guidance of the ion beam through a mass spectrometer apparatus is generally controlled via shaped electric fields provided by suitably positioned electrodes which operate at controlled voltages. Arrangements of this type are normally referred to as ion optics systems.

One example of an ion optics system is that described in U.S. Pat. No. 6,614,021 to Varian Australia. Pty Ltd. Although the arrangement described in US'021 is thought to operate adequately, there are thought to be limitations to its measurement sensitivity at some ion energy levels.

SUMMARY OF THE INVENTION

According to one principal aspect of the present invention, there is provided an ion deflector for modifying the path of travel of a beam of ions in a mass spectrometer, the deflector including an electric field inducer arranged so as to establish more than one electrostatic field capable of deflecting ions travelling substantially along a first intended path of travel so as to travel substantially along a second intended path of travel.

According to another principal aspect of the present invention, there is provided an ion deflector for modifying the path of travel of a beam of ions in a mass spectrometer, the deflector including an electric field inducer arranged so as to establish more than one electrostatic field capable of deflecting the ions from one or more incident angles towards a predetermined focal point.

According to another principal aspect of the present invention, there is provided an ion deflector for use with a mass spectrometer for deflecting a flow of ions between two distinct axes of travel, the deflector having an electric field inducer arranged so as to establish more than one electrostatic field capable of causing a flow of ions travelling along a first of said axes of travel to be focused toward a spatial region of intended focus which is substantially aligned with the other of said axes of travel.

The electric field inducer may comprise a chargeable component which includes more than one (or a number of) chargeable elements. The or each of the chargeable elements may be arranged with a voltage source so that they each exhibit either a positive or negative bias voltage potential.

In one embodiment, each chargeable element may represent a segment of the chargeable component. Thus, the chargeable component may be composed of more than one chargeable segments.

It will be appreciated that when a chargeable element (or segment) is provided with a bias voltage potential, the electric field produced is an electric monopole field in which the direction of the electric field lines depends on whether the bias voltage potential applied is positive (where the electric field lines are directed radially outwardly from the chargeable element) or negative (where the electric field lines are directed radially inwardly toward the chargeable component).

Accordingly for the above-described principal aspects of the present invention, and for those which follow, the electric field inducer is preferably arranged so as to establish more than one electric monopole field. In this regard, guidance of the ions in three-dimensional space is, at least in part, achieved by the resulting influence, or net effect, of the established electric fields. Therefore, in one embodiment, selective manipulation (or steering) and/or selective focusing of the ion beam results, at least in part, from exploitation of the superposition of the electric fields established by each of the chargeable elements (or segments) of the electric field inducer. Thus, the electric field inducer may be arranged so as to establish more than one electrostatic monopole field, the superposition of which is capable of allowing the ions to be selectively steered within three-dimensional space as required.

In a preferred embodiment, each of the chargeable elements is provided with a substantially negative bias voltage potential relative to the potential of the ions entering the mass spectrometer (that is, the potential of the source of the ions).

Preferably, the first and second intended paths of travel of the ions reside within the same plane, or plane of flow. It will be appreciated however that a deflector of the present invention could be arranged and employed to cause an out-of-plane deflection depending on the specific arrangement of the mass spectrometry device, such as the position of the mass detector unit relative to the ion source.

In one embodiment, the chargeable component comprises four chargeable elements, each arranged such that they are provided with a substantially negative bias voltage potential relative to the voltage potential when measured at the ion source. In this arrangement, the electric field inducer provides four electric monopole fields.

In one embodiment, the chargeable elements are operably arranged in pairs, with each half of the pair (comprising constituent chargeable elements) configured to oppose the other. By applying a bias voltage differential across the chargeable elements which constitute the pair, the electrostatic field can be used to control the direction and/or focus of the ion beam.

One of the operable pairs may be arranged so that the applied bias voltage differential across the constituent chargeable elements is variable by a nominated or predetermined amount. This variability in bias voltage potential serves to provide the differential in voltage potential between constituent chargeable elements in the pair, thereby allowing the ion beam to be manipulated or 'steered' so that it may be focused appropriately toward a predetermined spatial region. The chargeable components of each chargeable element pair are arranged relative to one another so that their geometrical arrangement is configured relative to the flow of the ion beam, so as to give effect to the desired direction of manipulation of the ion beam when the voltage differential is applied.

In one embodiment, the chargeable component is circular and comprises four equally shaped chargeable elements. Thus, the chargeable component in that embodiment comprises two axes of symmetry.

In one arrangement of this embodiment, the chargeable component is aligned so that both axes of symmetry are not aligned with the plane of flow. In this arrangement, opposing chargeable elements (for example, those elements which are positioned apex to apex) may be operably arranged in respective pairs. Applying a bias voltage differential between the chargeable elements (or pair) which reside generally within the plane of flow allows the ion beam to be manipulated within that plane. Furthermore, applying a bias voltage differential between the chargeable elements (or pair) which reside generally out of the plane of flow allows the ion beam to be manipulated substantially orthogonally to the plane of flow.

In another arrangement, one axis of symmetry is aligned substantially with the plane of flow and the other axis of symmetry is aligned substantially orthogonally to the plane of flow. In this arrangement, manipulation of the ion beam within the plane of flow is performed by establishing a bias voltage differential between one or more chargeable elements opposed about the axis of symmetry which is aligned substantially orthogonally to the plane of flow. Similarly, manipulation of the ion beam out of the plane of flow is performed by establishing a bias voltage differential between one or more chargeable elements opposed about an axis of symmetry which is aligned substantially with the plane of flow.

The chargeable component may be provided in the form of a substantially conical shape, or portion thereof. In this configuration, and for the case where the chargeable component comprises four chargeable elements, each chargeable element represents a quarter section of the conical form. The skilled person will appreciate that the chargeable component may be provided in the form of other geometrical shapes, or portions thereof.

For the case where the chargeable component comprises more than one chargeable element, each chargeable element may be electrically separated from one another by way of a dielectric substrate. In such cases, a dielectric or similar material is placed intermediate like or adjacent chargeable elements.

The chargeable component is sufficiently positioned relative to the beam of ions so as to create an electric field capable of deflecting the ion beam in a predetermined manner. Generally, the intended pathway of the ion beam will flow about a circumferential portion of the chargeable component.

The ion deflector may comprise a grounded element which is generally arranged so as to be electrically grounded. In some embodiments, the grounded element may have a slight voltage bias depending on the arrangement employed. However, the bias voltage potential applied to the grounded element, if any, will not be of the same magnitude as that applied to the or each chargeable element(s).

The bias voltage potential applied to the grounded element may be either positive or negative. Preferably however, any bias potential applied to the grounded element is negative.

A portion of the grounded element may include a region of mesh or similar structure provided by a meshed element. The meshed element may be arranged with a voltage source so as to be capable of providing the grounded element with the required/desired bias voltage potential, if any.

The grounded element, and/or meshed element, may be made from any suitable metallic material, such as nickel or stainless steel. Furthermore, the size of the interstices of the mesh of the meshed element may be in the order of, for example, 5 mm or greater.

In other embodiments, the grounded element may have one or more apertures provided therein. For example, in one such embodiment, the grounded element may include a single aperture which may be arranged substantially concentric with one or both of the first or second intended paths of travel. The shape of such an aperture may be any appropriate shape such as, for example, circular or oval.

In one embodiment, the grounded element may be circular or oval in geometry and located and/or arranged in such a manner so as to oppose the chargeable component. In such configurations, the grounded element and the chargeable component are arranged relative to one another so that the ion beam flows therebetween. For the case where the chargeable component is of a generally conical form, the grounded element and chargeable component may be configured so that the divergent end of the conical form faces the grounded element.

The grounded element may be substantially two-dimensional in nature and be of any planar (substantially flat) shape such as for example, circular, oval or the like. The circumferential shape of the grounded element may be substantially segmented (such as by having a plurality of segments, which segments may be substantially straight) or be substantially curvilinear in nature.

The grounded element may also have a depth component and therefore be three-dimensional in nature. In this regard, the depth component, as a function of the planar shape, may be segmented or curvilinear (for example having concave or convex curvature). It will therefore be appreciated that the grounded element could comprise many possible three-dimensional shapes.

Non-limiting examples may include spherical, parabolic or elliptical two- or three-dimensional forms. The skilled person will appreciate that the grounded element may be provided in the form of many different two- or three-dimensional shapes.

For the above-described principal aspects of the invention, and for those which follow, the spatial region of intended focus is representative of a region of space toward which the flow of ions is focused or concentrated (that is, a focal point) such that the ionic flux flowing substantially through the region of space is enhanced and the spatial distribution of the ion beam is reduced within that region. The spatial region of intended focus is often provided at or near an inlet region through which ions are directed for subsequent spectrometric analysis. In some embodiments, the region of space will often be provided at or near the entrance of a mass analyzer or collisional cell arrangement which is a component part of the overall configuration of the mass spectrometer apparatus.

Preferably, the flow of ions can be concentrated or focused toward the ion deflector by any ion thermalising device such as an ion funnel, ion guide or any other device employing residual pressure collision cooling or collisional focusing functionality. In this manner, a beam of ions extracted from the ion source can be focused or concentrated so that it is directed toward the ion deflector having enhanced ionic flux and/or reduced energy distribution characteristics.

Typically, the spatial region of intended focus will be spatially distinct from the entrance to the ion deflector whereby the positional relationship between both is a function of the specific configuration of the electric field inducer arrangement. In one embodiment, the electric field inducer is arranged so that the spatial region of intended focus is spaced sufficiently from the entrance to the ion deflector so that the ions are deflected between the first and second axes of travel.

Preferably, the electric field inducer is arranged so that the position of the spatial region of intended focus, and therefore the direction of flow of the ions, is predetermined.

It will be appreciated that the relative angle between the first and second axes of travel can vary depending upon the mass spectrometry arrangement desired. For example, deflection of the ion beam has been found to increase the measurement sensitivity of a mass spectrometer by deflecting only the target ions, thereby removing undesirable particles from the ion beam stream. Such arrangements may therefore avoid the need for collisional or reaction cells which generally seek, by way of providing a collisional atmosphere, to improve the target ion density. In addition, the ability to manipulate or steer the ion beam can allow designers flexibility in developing mass spectrometer devices which are more compact and take up less bench space or which have relaxed mechanical tolerances.

In one embodiment, the electric field inducer may be arranged so that the ions are deflected between the first and second axes of travel (or first and second intended paths of travel) when the axes are aligned at substantially 90 degrees to one another.

According to another principal aspect of the present invention, there is provided an ion deflector for use with a mass spectrometer for directing a flow of ions between two distinct axes of travel, the deflector comprising, an electric field inducer arranged so as to establish more than one electrostatic field capable of causing a flow of ions flowing along a first axis of travel to flow toward a spatial region of intended focus so that the spatial distribution of the ions flowing through the spatial region of intended focus is substantially reduced relative to that of the ions entering the mass spectrometer.

According to a further principal aspect of the present invention, there is provided an ion deflector for use with a mass spectrometer for directing a flow of ions between two distinct axes of travel, the deflector comprising an electric field inducer arranged so as to establish more than one electrostatic field capable of causing a flow of ions flowing along a first axis of travel to flow toward a spatial region of intended focus so that the ionic flux of the ions flowing through the spatial region is substantially greater relative to that of the ions entering the mass spectrometer.

According to a further principal aspect of the present invention, there is provided a sampling interface for use with mass spectrometry apparatus, the sampling interface arranged so as to enable the sampling of ions in a mass spectrometer for spectrometric analysis, the sampling interface capable of receiving a quantity of ions extracted from an ion source for providing a beam of ions travelling along a first axis of travel and to be directed along an intended pathway toward an ion detector arranged for receiving ions travelling along a second axis of travel, the interface including an ion deflector arranged in accordance with any of the embodiments of the above-described principal aspects of the present invention for deflecting the beam of ions between the first and second axes of travel.

The sampling interface may be arranged so as to be associable with at least one of the following mass spectrometry instrumentation: an atmosphere pressure plasma ion source (a low pressure or high pressure plasma ion source can be used) mass spectrometry such as inductively coupled mass spectrometry (ICP-MS), microwave plasma mass spectrometry (MP-MS), glow discharge mass spectrometry (GD-MS) or optical plasma mass spectrometry (for example, laser induced plasma), gas chromatography mass spectrometry (GC-MS), liquid chromatography mass spectrometry (LC-MS), and ion chromatography mass spectrometry (IC-MS). Furthermore, other ion sources may include, without limitation, electron ionization (EI), direct analysis in real time (DART), desorption electro-spray (DESI), flowing atmospheric pressure afterglow (FAPA), low temperature plasma (LTP), dielectric barrier discharge (DBD), helium plasma ionization source (HPIS), desorption atmospheric pressure photo-ionization (DAPPI), and atmospheric or ambient desorption ionization (ADI). The skilled reader will appreciate that the latter list is not intended to be exhaustive, as other developing areas of mass spectrometry may benefit from the principles of the present invention.

According to a further principal aspect of the invention, there is provided a mass spectrometer incorporating any embodiment of the above-described ion deflector arranged in accordance with the present invention.

According to another principal aspect of the invention, there is provided an inductively coupled plasma mass spectrometer incorporating any embodiment of the above-described ion deflector arranged in accordance with the present invention.

According to another principal aspect of the invention, there is provided an atmospheric pressure ion source mass spectrometer incorporating any embodiment of the above-described ion deflector arranged in accordance with the present invention.

According to a further principal aspect of the invention, there is provided a mass spectrometer incorporating any embodiment of the above-described sampling interface arranged in accordance with the present invention.

According to another principal aspect of the invention, there is provided an inductively coupled plasma mass spectrometer incorporating any embodiment of the above-described sampling interface arranged in accordance with the present invention.

According to another principal aspect of the invention, there is provided an atmospheric pressure ion source mass spectrometer incorporating any embodiment of the above-described sampling interface arranged in accordance with the present invention.

According to a further principal aspect of the present invention, there is provided a sampling interface for use with mass spectrometry apparatus, the interface comprising:

an ion focusing device arranged so as to focus ions extracted from an ion source toward an ion deflector, the ion deflector having an electric field inducer capable of providing more than one electric field capable of focusing the flow of ions toward a spatial region of intended focus.

The ion deflector may comprise any of the features described in relation to any of the above described principal aspects of the present invention.

The ion focusing device may comprise any ion thermalising device such as an ion funnel, ion guide or any other device employing residual pressure collision cooling or collisional focusing functionality. Such devices may incorporate arrangements such as those described in Australian provisional patent application no 2011904560, the contents of which are incorporated herein by reference.

According to another principal aspect of the present invention, there is provided a method for modifying the path of travel of a beam of ions in a mass spectrometer, the method including the step of establishing more than one electrostatic field capable of deflecting ions travelling substantially along a first intended path of travel to flow along a second intended path of travel for spectrometric analysis.

According to another principal aspect of the present invention, there is provided a method for modifying the path of travel of a beam of ions in a mass spectrometer, the method including the step of deflecting ions travelling substantially along a first intended path of travel towards a spatial region of intended focus by applying more than one electrostatic field to the ions.

According to another principal aspect of the present invention, there is provided a method for modifying the path of travel of a beam of ions in a mass spectrometer, the method including the step of deflecting the ions from one or more incident angles towards a spatial region of intended focus by applying more than one electrostatic field to the ions.

According to another principal aspect of the present invention, there is provided a method for deflecting ions in an ion beam between two distinct axes of travel, the method comprising the step of providing an ion deflector having an electric field inducer arranged for establishing more than one electrostatic field capable of deflecting a flow of ions between two distinct axes of travel.

In one embodiment, the ion deflector is arranged in accordance with any of the embodiments described in relation to any of the principal aspects of the present invention described above.

The method may further comprise the step of directing a flow of ions extracted from an ion source so that the ion flow is focused or concentrated toward the entrance region of the ion deflector. This step may be provided by using any ion thermalising device such as an ion funnel, ion guide or any other device employing residual pressure collision cooling or collisional focusing functionality.

The method may further comprise the step of arranging the ion deflector so as to concentrate or focus the ion beam toward a spatial region of intended focus located at or near the entrance to a mass analyzer device (such as a quadrupole mass analyzer arrangement) or collisional cell arrangement.

The electric field inducer may be appropriately configured so that the energy distribution of the ions at the entrance region of the ion deflector is substantially the same as that at the spatial region of intended focus.

The electric field inducer may comprise any of the embodiments described in accordance with any of the above-described principal aspects of the present invention.

BRIEF DESCRIPTION OF THE DRAWINGS

Embodiments of the invention will now be further explained and illustrated, by way of example only, with reference to any one or more of the accompanying drawings in which.

DETAILED DESCRIPTION

Figure 1:
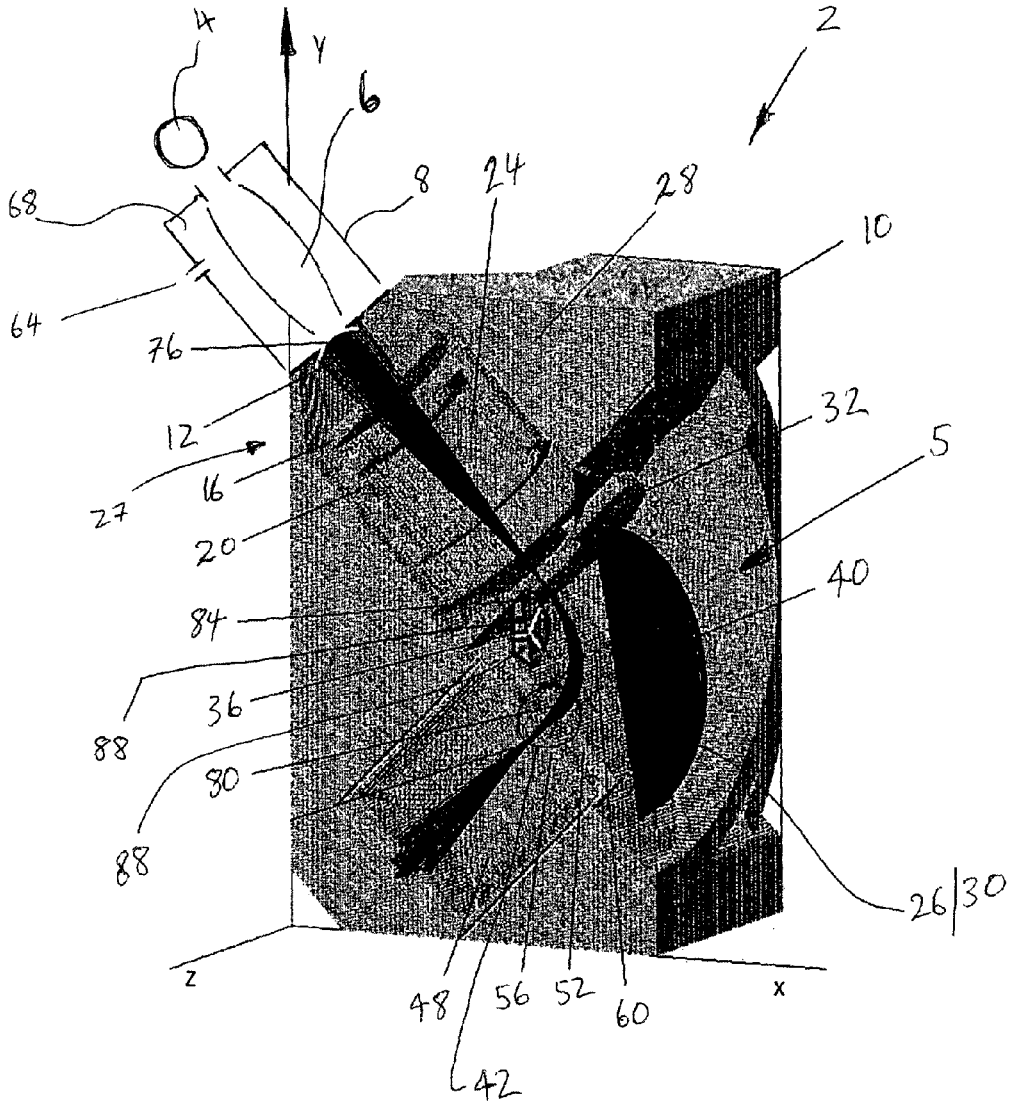
FIG. 1 shows a schematic perspective view of one embodiment of the present invention prepared using computer modeling software.

For brevity, a number of embodiments of the present invention will be described with specific regard to atmospheric pressure mass spectrometry devices. However, it will be appreciated that the substance of the described embodiments may be readily applied to any mass spectrometry instrumentation, including those having any type of collisional atmosphere (including, but not limited to multi-pole collisional or reaction cells) arrangements used for selective ion particle fragmentation, attenuation, reaction, collisional scattering, manipulation, and redistribution with the purpose of mass-spectra modification. Accordingly, the following mass spectrometry devices may benefit from the principles of the present invention: atmosphere pressure plasma ion source (low pressure or high pressure plasma ion source can be used) mass spectrometry such as inductively coupled mass spectrometry (ICP-MS), microwave plasma mass spectrometry (MP-MS) or glow discharge mass spectrometry (GD-MS) or optical plasma mass spectrometry (for example, laser induced plasma), gas chromatography mass spectrometry (GC-MS), liquid chromatography mass spectrometry (LC-MS), and ion chromatography mass spectrometry (IC-MS). Furthermore, other ion sources may include, without limitation, electron ionization (EI), direct analysis in real time (DART), desorption electro-spray (DESI), flowing atmospheric pressure afterglow (FAPA), low temperature plasma (LTP), dielectric barrier discharge (DBD), helium plasma ionization source (HPIS), desorption atmospheric pressure photo-ionization (DAPPI), and atmospheric or ambient desorption ionization (ADI). The skilled reader will appreciate that the latter list is not intended to be exhaustive, as other developing areas of mass spectrometry may benefit from the principles of the present invention.

Most mass spectrometer devices include an ion optics arrangement which is configured to focus and move the ions into an ion beam manipulator (if used) such as any known collisional or reaction cell. The purpose of this component is to modify the ion beam by a physical and/or chemical means for specific spectroscopic needs. For example, in the ICP-MS field, providing an 'interference' environment (that is, one containing a specific gas or environment which purposefully interferes with an unwanted particle or particles known to be present in the ion beam) can improve the measurement of a specific kind of 'target' ion which is desired to be measured.

Mass spectrometry can often benefit by using a number of mass-analyzers in sequence and ion beam manipulators of different kinds. Quadrupole mass-analyzer units operate sequentially. The spectra are obtained in sequence allowing only one mass-m/z measurement at a time, and can therefore be time consuming when many masses are needed to be measured. Furthermore, precise isotopic ratio measurements using such sequential methods can be problematic when the ion source and/or sample introduction systems oscillate or flicker, creating unstable (in time) ion beams for subsequent measurement.

Figure 2:
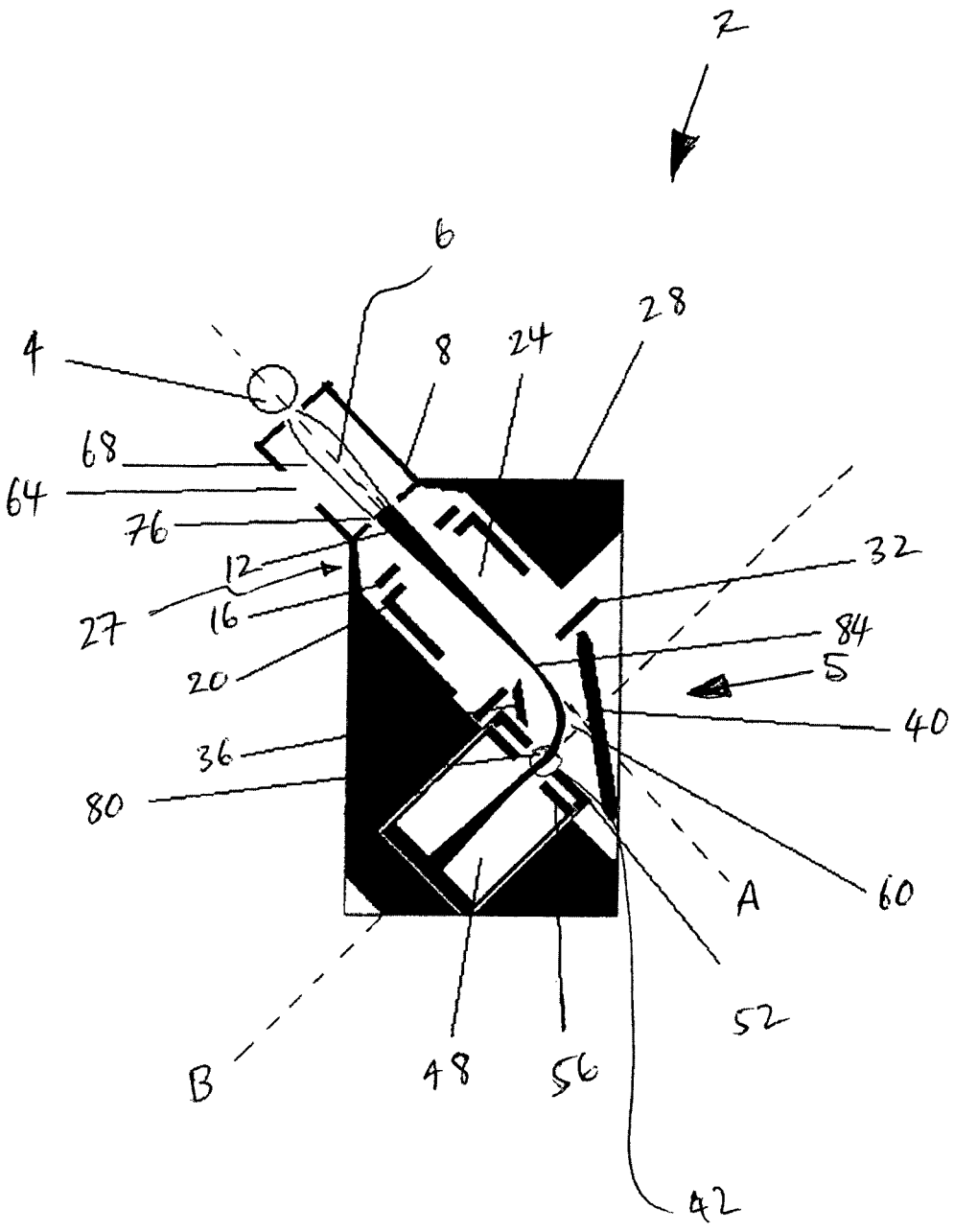
FIG. 2 shows a schematic (section) view of one embodiment of the alignment between the two axes of travel of an ion flow deflected by an ion deflector arranged in accordance with one embodiment of the present invention.

With reference to FIG. 1 and FIG. 2, one embodiment of an ion deflector 5 arranged in accordance with the present invention is shown for use with a mass spectrometer arrangement 2 (which is configured as an atmospheric pressure plasma mass spectrometry apparatus). The ion deflector 5 is arranged for directing a flow of ions between two distinct axes of travel (axes A and B shown in FIG. 2) and includes an electric field inducer 10 which is arranged to cause a flow of ions travelling substantially along axis A (from an ion source 4) to be deflected (generally within region 60) so as to then travel substantially along axis B toward a mass analyzer 48.

It will be appreciated that the relative angle between the first A and second axes of travel can vary depending upon the mass spectrometry arrangement desired. For example, deflection of the ion beam has been found to increase the measurement sensitivity of mass spectrometers by deflecting only the target ions thereby removing undesirable particles from the ion beam stream. Such arrangements may therefore avoid the need for collisional or reaction cells which generally seek, by way of providing a collisional atmosphere, to improve the target ion density. In addition, the ability to manipulate or steer the ion beam can allow designers flexibility when developing mass spectrometry devices which are more compact and take up less bench space.

The ion source 4 includes electrodes or coils which are arranged for providing a quantity of ions from a specified sample for spectrometric analysis. The ions are extracted (6) into an ion thermalisation arrangement 8 which includes an ion cooler or focusing device 68 arranged to focus ions from the plasma so as to travel along an intended pathway—generally along axis A. The ion cooler or focusing device 68 may comprise arrangements exploiting the benefits of ion funnels or ion guides (tapered or other) having two or more poles. Any ion thermalisation arrangement 8 will generally include a pumping port 64.

In operation, a sample of ions is extracted from the ion thermalisation arrangement 8 into the mass spectrometer 2 through an aperture 76 by way of an ion extraction arrangement 27 held within body 28. The ion extraction arrangement 27 includes extracting electrodes 16 and 20 which serve to extract and focus the ions so as to form ion beam 12 which passes through region 24 en route to the ion deflector 5. It will be appreciated that region 24 could be occupied by one or more alternative ion optics lens arrangements. Ion deflector 5 further comprises, at its upstream end, a lens 32 through which the ion beam (at 84) enters the ion deflector 5 from the ion extraction arrangement 27.

The electric field inducer 10 comprises a chargeable component 36 which includes a number of chargeable elements 88 which can be arranged with a voltage source so that they each exhibit either a positive or negative bias voltage potential. In the embodiment shown, each of the chargeable elements 88 (four shown in the embodiments shown in the figures) is provided with a substantially negative bias voltage potential relative to the potential of the ions entering the mass spectrometer 2 (that is, the potential of the ions in regions 4/6). It will be understood that more or less chargeable elements 88 may be employed.

It will be appreciated by the skilled person that when a chargeable element 88 is provided with a bias voltage potential, the electric field produced is an electric monopole field in which the direction of the electric field lines depends on whether the bias voltage potential applied is positive (radially outwardly from the chargeable element) or negative (radially inwardly toward the chargeable component).

The electric field inducer 10 is therefore arranged so as to establish more than one electric monopole field. In this regard, guidance of the ions in three-dimensional space is, at least in part, achieved by the resulting influence, or net effect, of the established electric fields. Therefore, selective manipulation (or steering) and/or selective focusing of the ion beam results, at least in part, from exploitation of the superposition of the electric fields established by each of the chargeable elements (or segments) of the electric field inducer 10. Thus, the electric field inducer 10 is arranged so as to establish more than one electrostatic monopole field, the superposition of which is capable of allowing the ions to be selectively steered within three-dimensional space as required.

The arrangement of electric monopole fields provided by the electric field inducer 10 is such that the ions are deflected between the first A and second B axes of travel. The electric field inducer 10 is arranged so that the ions are deflected and appropriately focused toward a spatial region of intended focus 42 located at or near an entrance region 80 upstream of the mass analyzer 48. Within the entrance region 80 are entrance lens focusing electrodes 52 and 56, each being arranged to provide further focusing of the ion beam into the mass analyzer 48 (collisional cell or other compartment, for example). Alternatively, for example, the entrance region 80 could be located upstream of a collisional cell or indeed any other desired compartment which precedes a mass analyser unit.

Figure 3:
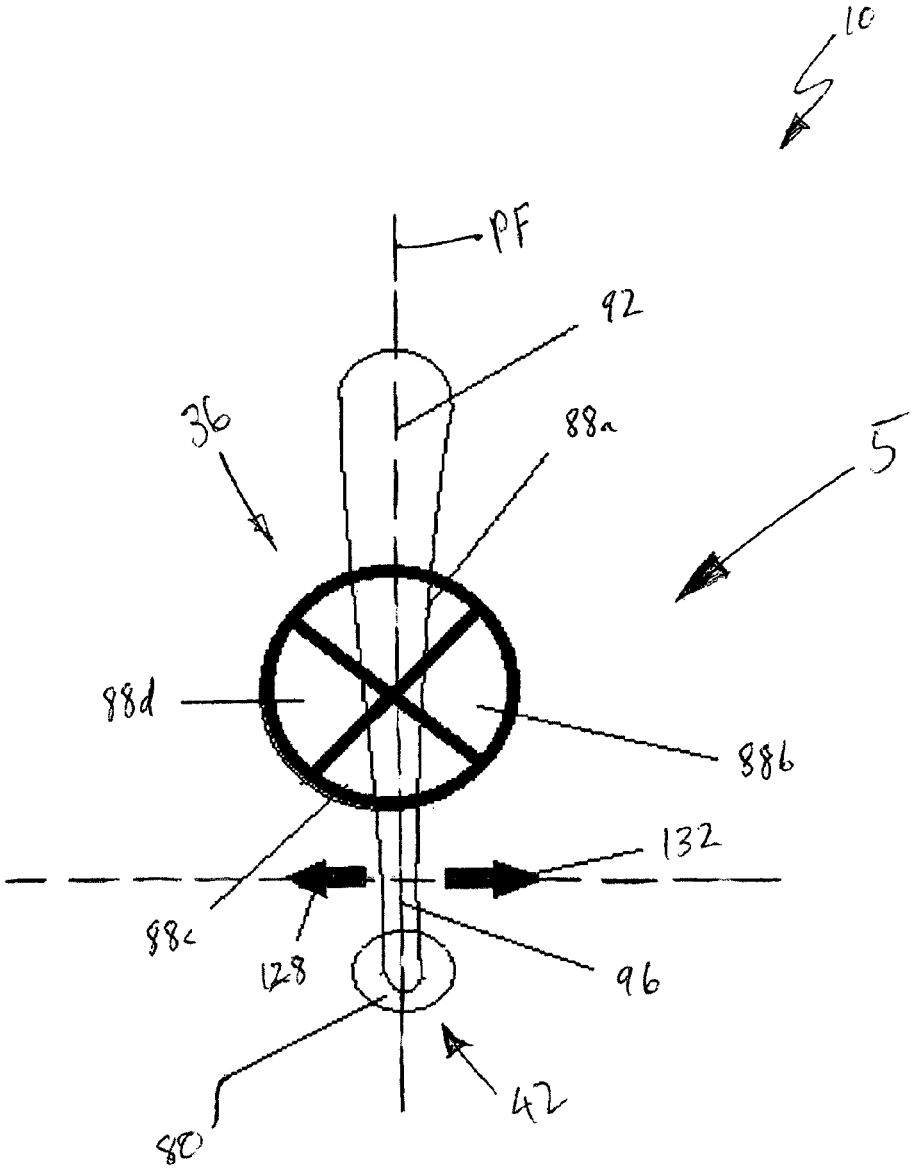
FIG. 3 shows a schematic view of another embodiment of the present invention.
Figure 4:
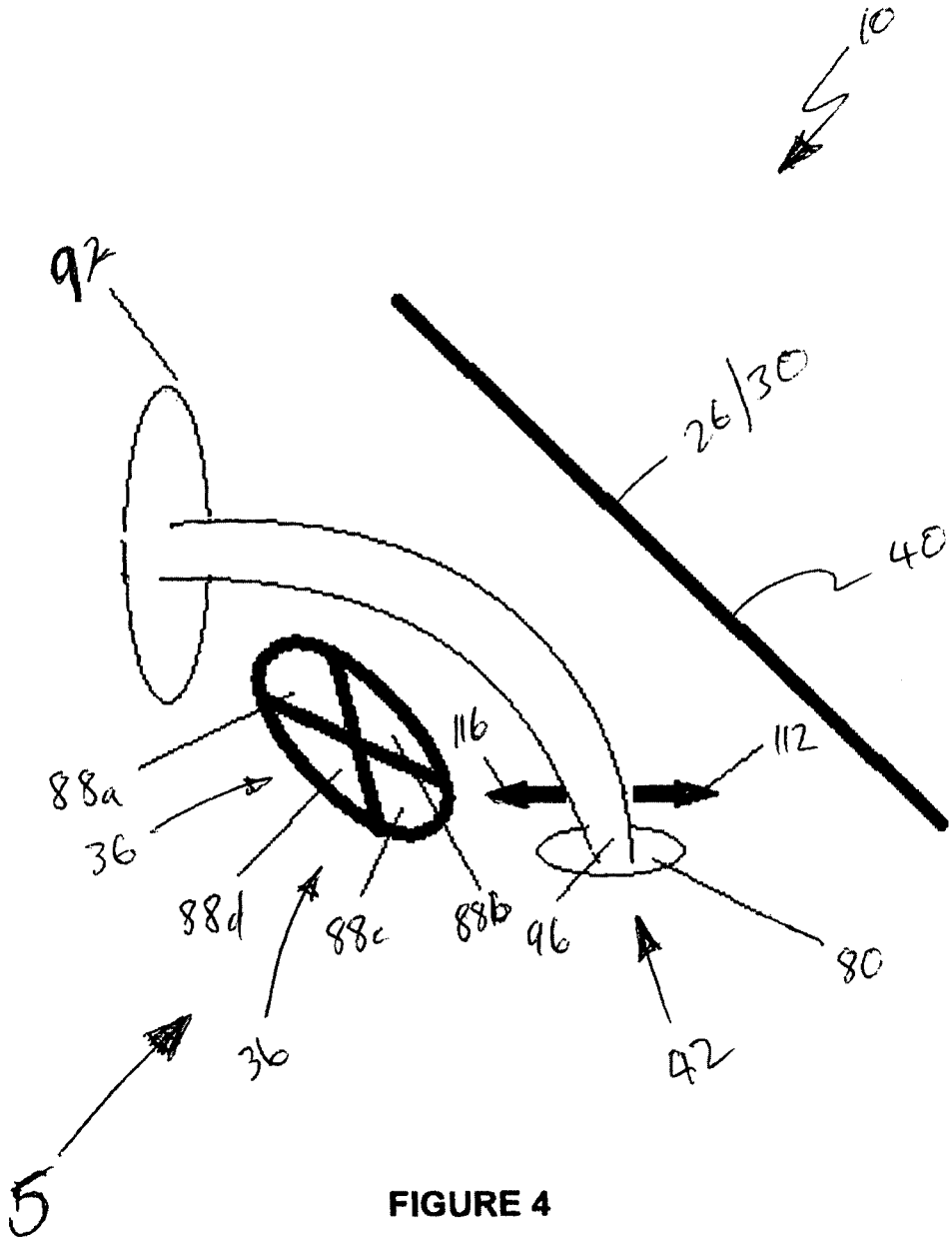
FIG. 4 shows a perspective view of the embodiment shown in FIG. 3.

One embodiment of the electric field inducer 10 is shown schematically in FIG. 3 and FIG. 4. In both figures, the ion beam flows within a plane of flow PF, and enters the ion deflector 5 at the region identified by reference numeral 92. The chargeable component 36 comprises chargeable elements 88*a*-88*d*. In the arrangement shown, the chargeable elements 88*a*-88*d* are operably arranged in pairs—a first pair comprising chargeable elements 88*a* and 88*c*, and a second pair comprising chargeable elements 88*b* and 88*d*. As is shown in the figures, each pair is arranged so that the constituent chargeable elements oppose one another (ie. opposing chargeable elements in a pair are arranged in an apex-apex configuration).

One or both of the pairs are arranged so that the applied bias voltage differential across the chargeable elements comprising the pair is variable by a nominated amount. This variability in bias voltage potential allows a region or end of the ion beam (generally identified by reference numeral 96) to be selectively manipulated or 'steered' so that region 96 may be focused toward an intended spatial region (that is, a focal point) appropriately. As shown in FIG. 3, the pair comprising chargeable elements 88*b* and 88*d* are operably arranged so as to allow the path of the ion beam to be manipulated or 'steered' out of the plane of flow PF in directions 128/132 (shown in FIG. 3). This may be necessary, for example, when tuning the ion deflector 5 so as to ensure the ion beam is appropriately focused toward the intended focal point (generally at the entrance region 80 to mass analyzer 48). Similarly, the pair comprising chargeable elements 88*a* and 88*c* is operably arranged so that the ion beam may be manipulated or steered within the plane of flow. PF as appropriate in directions 116 or 112 (shown in FIG. 4).

In addition, further manipulation of the ion beam can be provided by applying a voltage differential between chargeable elements 88*b*, 88*d* (so that both chargeable elements effectively operate as a single electrode) and chargeable elements 88*a*, 88*c* (both chargeable elements also effectively operating as a single electrode).

Without being bound by a particular preliminary configuration, for the case where the chargeable component 36 comprises two chargeable element pairs as shown in FIGS. 3 and 4, in operation, one pair may be arranged to have a bias voltage potential in the order of −200V applied to both of the constituent chargeable elements (such as the pair comprising chargeable elements 88*a* and 88*c*), and the remaining pair (the pair comprising chargeable elements 88*b* and 88*d*) may be arranged having a bias voltage potential of around −200V plus or minus a nominated voltage potential of 10V (thereby allowing steering in directions 128 or 132). It will be appreciated that any bias voltage potential (or range) may be used depending on, at least in part, the specific design and configuration of the chargeable component 36 (and/or its respective electrode(s)) to be employed.

Figure 5:
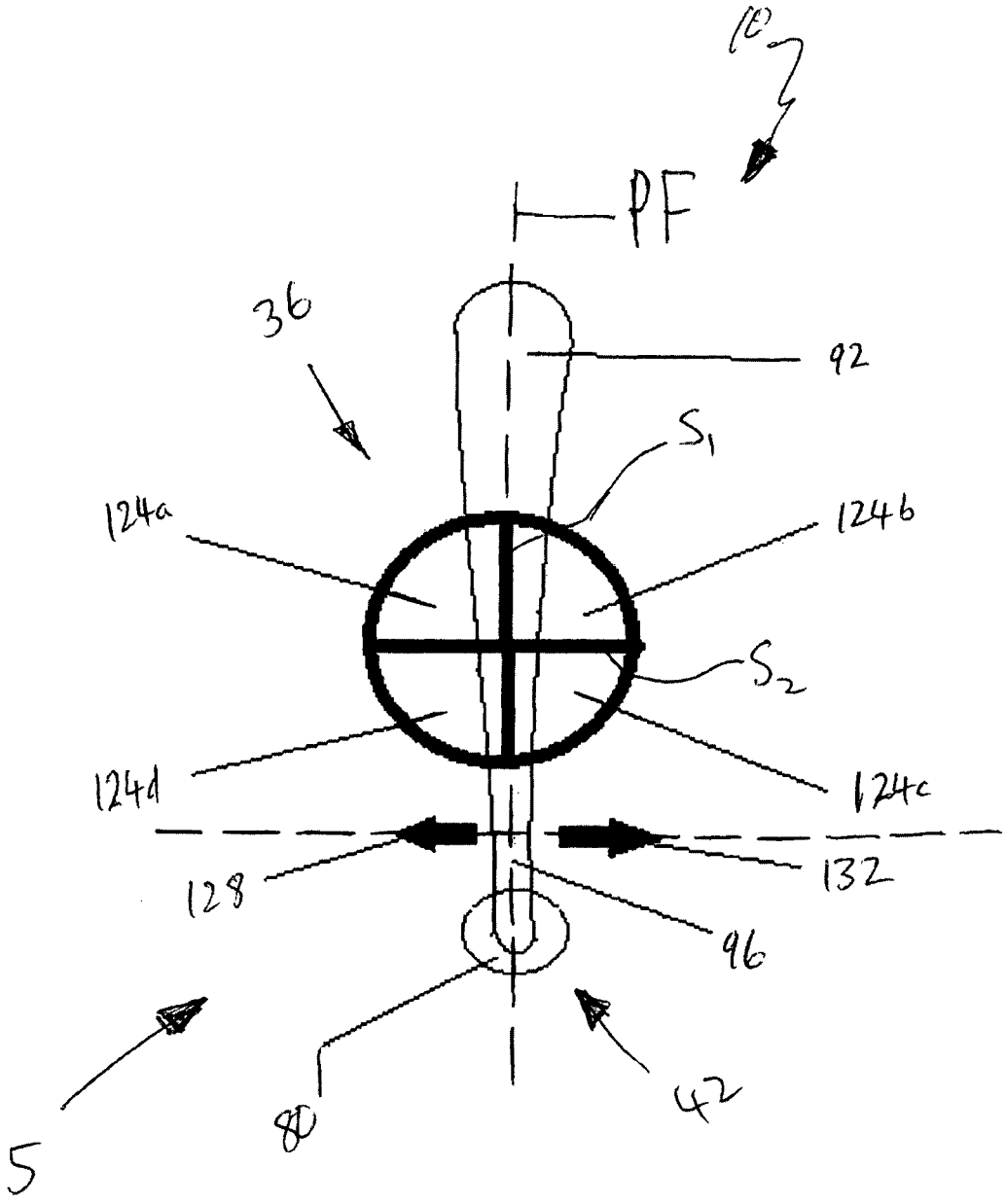
FIG. 5 shows a schematic view of another embodiment of the present invention.
Figure 6:
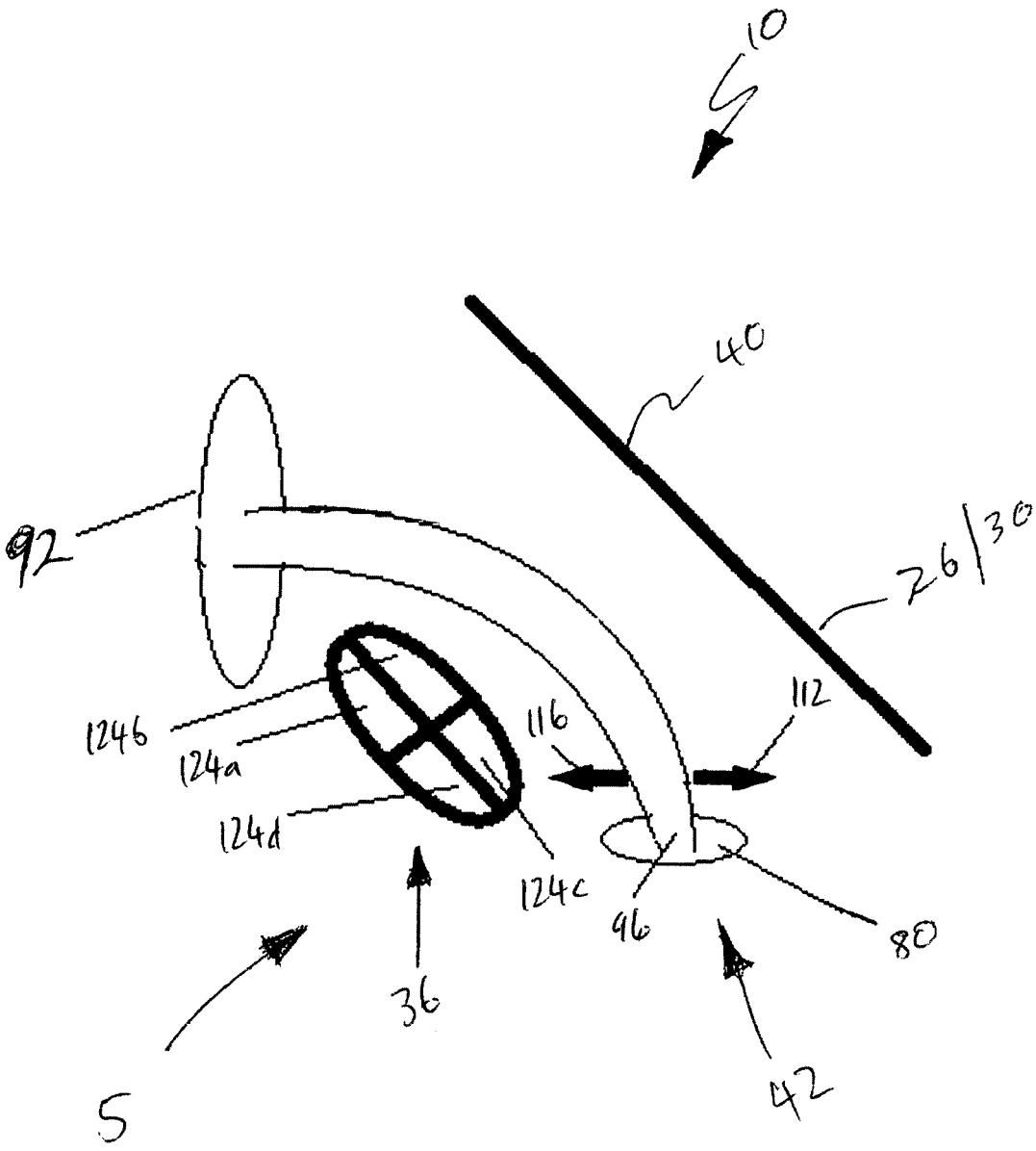
FIG. 6 shows a perspective view of the embodiment shown in FIG. 5.

Another arrangement of the chargeable component 36 is shown in FIGS. 5 and 6. In this configuration, the chargeable component 36 is equally divided into four chargeable elements 124*a*-124*d*. As shown in this configuration, the chargeable component 36 has two axes of symmetry: a first axis of symmetry $S_1$ is aligned substantially with the plane of flow PF, and a second axis of symmetry $S_2$ is aligned substantially orthogonal to the plane of flow. In this arrangement, chargeable elements 124*b* and 124*c* oppose chargeable elements 124*a* and 124*d* about the axis of symmetry $S_1$ respectively, and chargeable elements 124*a* and 124*b* oppose chargeable elements 124*d* and 124*c* about the axis of symmetry $S_2$ respectively. Chargeable elements 124*a* to 124*d* are operably arranged as appropriate so that region 96 of the ion beam may be selectively manipulated or steered in directions 128/132 (out of plane of flow PF) and/or 116/112 (within the plane of flow PF).

For the case where the beam is to be selectively steered in directions 128 or 132 (out of the plane of flow PF), a bias voltage differential is arranged between chargeable elements 124*a* and 124*b* (which oppose each other about axis of symmetry $S_1$) which serves to generate a movement of the region 96 of the ion beam in directions 128/132. It will also be appreciated that a similar effect could be established by a bias voltage differential being arranged between chargeable elements 124*d* and 124*c*, or if chargeable elements 124*a*, 124*d* were coupled together so as to operate with chargeable elements 124*b*, 124*c*. Thus, manipulation of the ion beam out of the plane of flow PF can be performed by establishing a bias voltage differential between one or more chargeable elements opposed about the axis of symmetry $S_1$.

For selectively steering the ion beam in directions 116/112 (within the plane of flow PF), a bias voltage differential is applied between chargeable elements 124*a*, 124*b* and chargeable elements 124*c*, 124*d* respectively. In this arrangement, chargeable elements 124*a*, 124*b* operate as a single electrode as do chargeable elements 124*c*, 124*d* for generating movement of region 96 of the ion beam in directions 116/112. Therefore, manipulation of the ion beam within the plane of flow PF can be performed by establishing a bias voltage differential between one or more chargeable elements opposed about the axis of symmetry $S_2$. It will be appreciated that embodiments of the chargeable component 36 may be suitably arranged so as to comprise more or less than four chargeable elements. As such, the chargeable elements may be operably arranged with one another depending, at least in part, on their specific geometrical configuration, and suitably arranged so the ion beam may be manipulated or steered as appropriate.

For the embodiments shown, the chargeable component 36 is provided in substantially conical form, in which each of the chargeable elements 88/124 represent a quarter section (or quarter wedge) of the chargeable component 36. Furthermore, it will be readily appreciated that the chargeable component 36 may be provided in other geometrical forms as appropriate.

The chargeable elements 88/124 are electrically separated from one another by way of a dielectric substrate (not shown). In this regard, the chargeable component 36 is arranged so that the chargeable elements 88/124 are separated from each other by way of a dielectric material placed therebetween so as to electrically isolate each of the chargeable elements 88/124 from one another. It will be readily appreciated by the skilled person that the chargeable elements 88/124 may be made from any material capable of receiving a bias voltage potential.

The ion deflector 5 further comprises a grounded element 40 which is generally arranged so as to be electrically grounded. In some embodiments, the grounded element 40 has a slight voltage bias depending on the electric field inducer arrangement employed. However, the bias voltage potential applied to the grounded element 40, if any, will not be of the same magnitude as that applied to the chargeable elements 124. The bias voltage potential applied to the grounded element 40 may be either positive or negative. Preferably, any bias voltage potential applied to the grounded element is negative.

A portion of the grounded element 40 may include a region of mesh 26 provided by a meshed element 30. The meshed element 30 is arranged with a voltage source so as to be capable of providing the grounded element 40 with the required/desired bias voltage potential, if any.

The grounded element 40, and/or meshed element 30, may be made substantially from any metallic material such as nickel or stainless steel. Furthermore, the size of the mesh of the meshed element 30 may be in the order of, for example, 5 mm or greater.

The grounded element 40 may be circular or oval in geometry and located and/or arranged in such a manner so as to oppose the chargeable component 36. In this configuration, the grounded element 40 and the chargeable component 36 are arranged relative to one another so that the ion beam flows therebetween. For the case where the chargeable component 36 is generally conical in form, the grounded element 40 and chargeable component 36 may be configured so that the divergent most end of the conical form faces the grounded element 40.

The skilled person will readily appreciate that the grounded element 40 may be substantially two-dimensional of any planar (substantially flat) shape such as for example, circular, oval or the like. The circumferential shape of the grounded element may be segmented (such as by having a plurality of segments, which segments may be substantially straight) or be curvilinear in nature.

In other embodiments, the grounded element 40 may have a depth component and therefore be three-dimensional in nature. In this regard, the depth component, as a function of the planar shape, may be segmented or curvilinear (for example having concave or convex curvature). It will therefore be appreciated that the grounded element 40 could comprise many possible three-dimensional shapes. Non-limiting examples may include spherical, parabolic or elliptical two- or three-dimensional forms. Thus, the skilled person will appreciate that the grounded element 40 may be provided in the form of many different two- or three-dimensional shapes.

It will be appreciated that modifications and improvements to the present invention will be readily apparent to those skilled in the art. Such modifications and improvements are intended to be within the scope of this invention. Examples of a variety of different arrangements which could be configured to incorporate the above described embodiment of the ion deflector 5 are shown in each of FIGS. 7 to 16.

Figure 7:
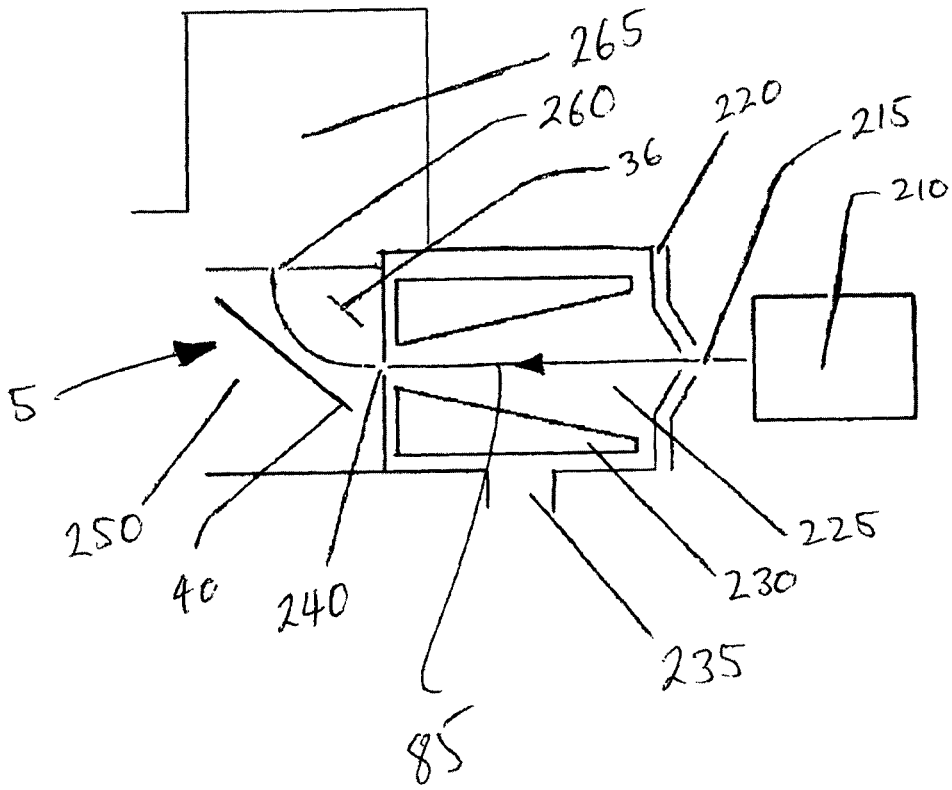
FIG. 7 shows a schematic (section) view of a mass spectrometry arrangement incorporating an ion deflector arranged in accordance with one embodiment of the present invention.

FIG. 7 shows a mass spectrometry arrangement comprising an ion source 210 from which ions are extracted through inlet 215 and through a curtain gas arrangement 220. The ions then enter a thermalising device (such as an ion funnel, tapered or shaved ion guide) comprising a modified ion guide arrangement 230 which serves to focus the ion beam toward aperture 240 so as to enter an ion optics arrangement contained within chamber 250. The thermalisation device is contained within chamber 225 which is connected to pumping port 235. The ion optics arrangement held within chamber 250 comprises an ion deflector arrangement 5 configured in accordance with the present invention so as to deflect and focus the ion flow toward the entrance 260 of mass-analyser compartment 265. The direction of the ion beam flow is generally referenced as numeral 85.

Figure 8:
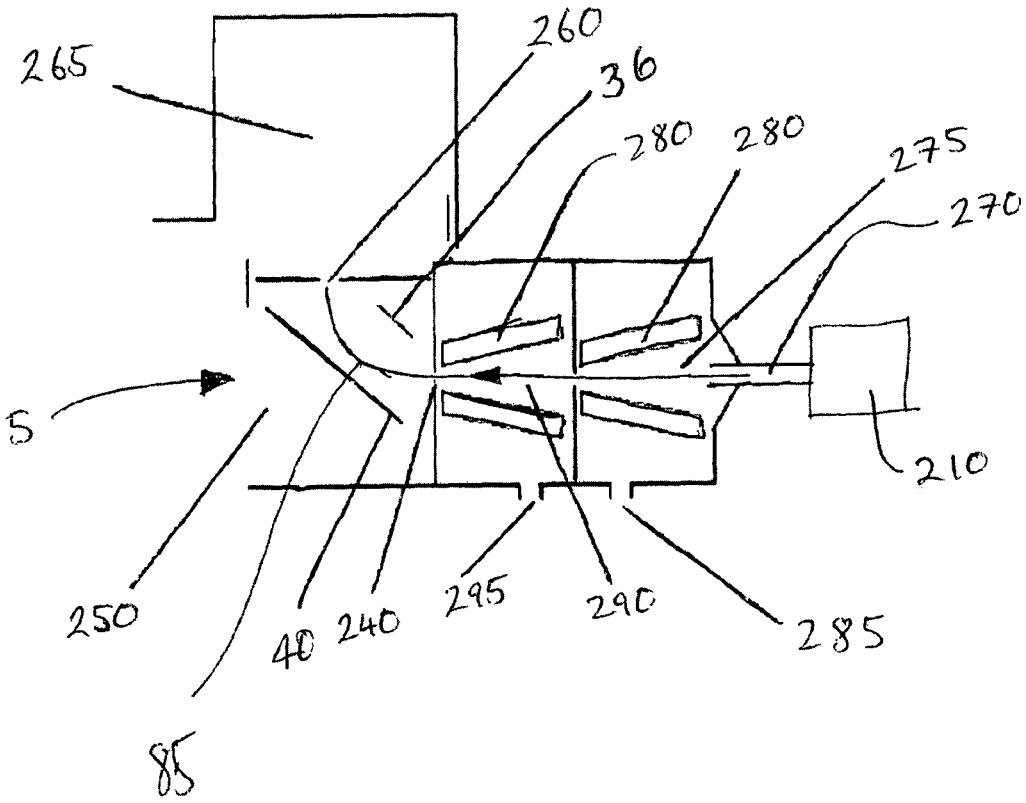
FIG. 8 shows a schematic (section) view of another mass spectrometry arrangement incorporating an ion deflector arranged in accordance with one embodiment of the present invention.

A similar mass spectrometry arrangement is shown in FIG. 8. However, chamber 225 is replaced by chambers 275 and 290 which contain respective thermalisation devices 280 for refining the beam of ions. The ions are received by chamber 275 by way of an ion capillary or ion transportation device 270 which serves to facilitate ion flow from the ion source 210. Chambers 275 and 290 are each regulated by pumping ports 285 and 295 respectively.

Figure 9:
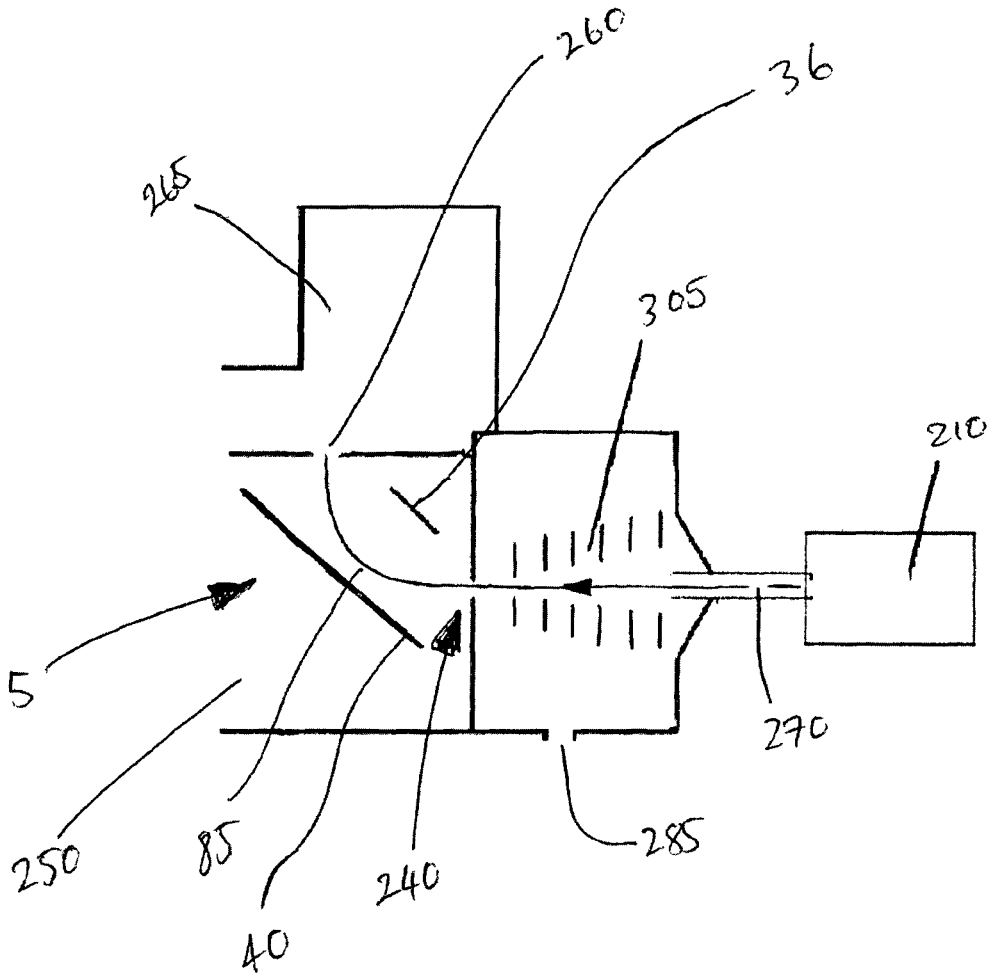
FIG. 9 shows a schematic (section) view of another mass spectrometry arrangement incorporating an ion deflector arranged in accordance with an embodiment of the present invention.
Figure 10:
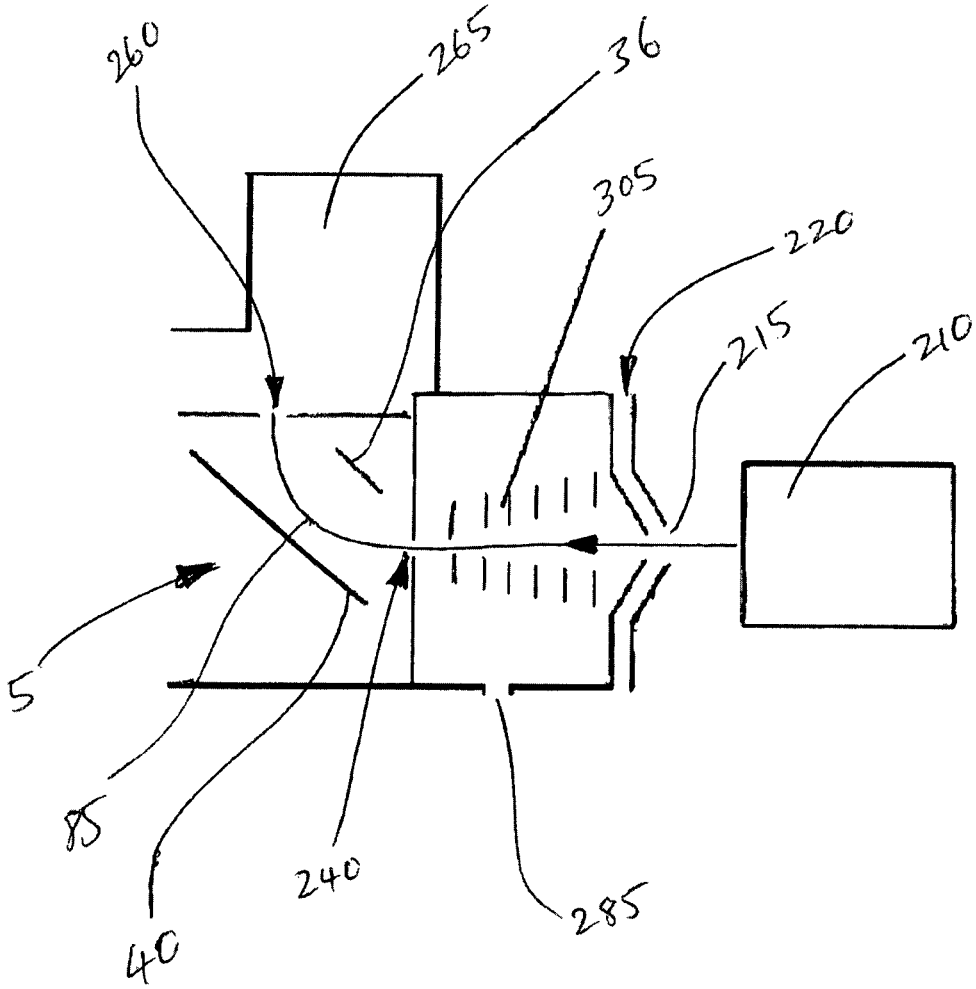
FIG. 10 shows a schematic (section) view of a further mass spectrometry arrangement incorporating an ion deflector arranged in accordance with an embodiment of the present invention.
Figure 11:
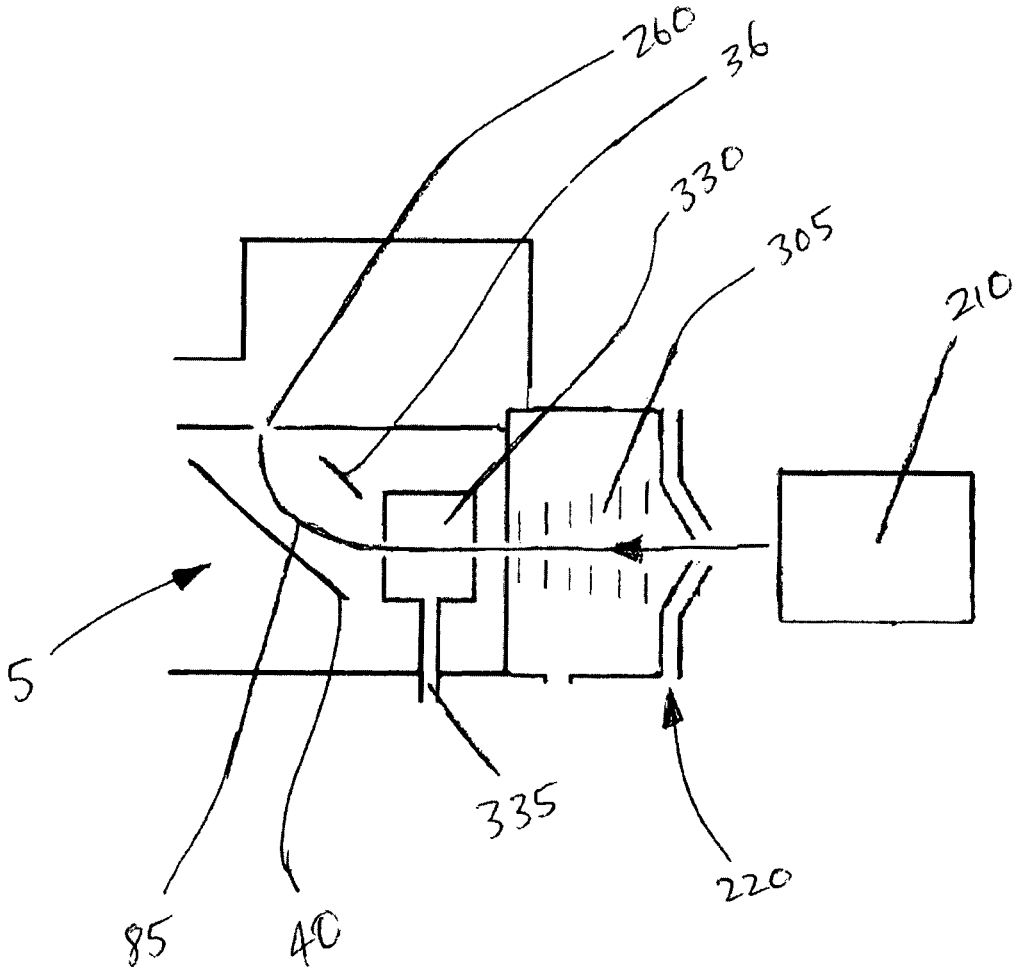
FIG. 11 shows a schematic (section) view of a further mass spectrometry arrangement incorporating an embodiment of the present invention.

A further mass spectrometry arrangement is shown in FIG. 9 which retains a similar structure to that shown in FIG. 7. The arrangement shown employs a single thermalisation device 305 which receives ions using the ion capillary or ion transportation device 270. The arrangement shown in FIG. 10 retains the thermalisation device 305 but is instead configured downstream of the gas curtain arrangement 220 (shown in FIG. 7).

The mass spectrometry arrangements shown in FIGS. 11 to 14 can also be arranged so as to incorporate a collisional or reaction cell 330 which is placed between the thermalisation device 305 and the ion deflector arrangement 5. The or each collisional cell may be arranged so as to accommodate one or more reaction or collisional gases (via gas inlet port 335) such as ammonia, methane, oxygen, nitrogen, argon, neon, krypton, xenon, helium or hydrogen, or mixtures of any two or more of them, for reacting with ions extracted from the plasma. It will be appreciated that the latter examples are by no means exhaustive and that many other gases, or combinations thereof, may be suitable for use in such collisional cells.

Figure 12:
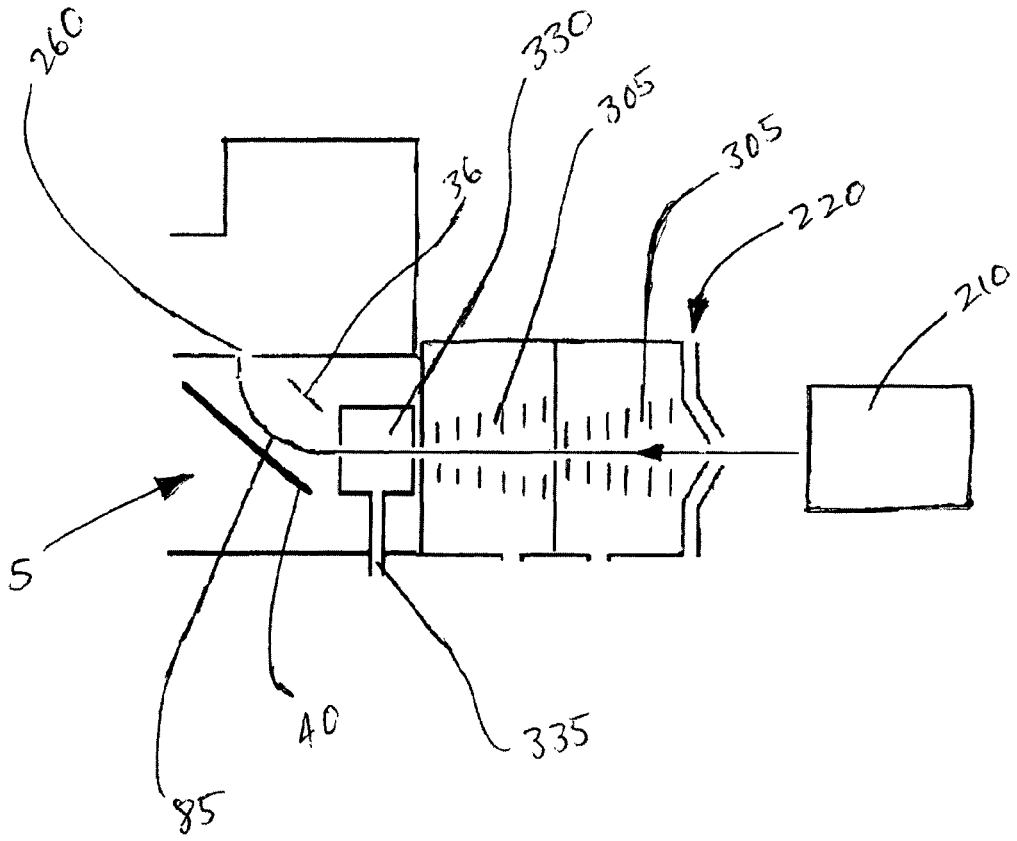
FIG. 12 shows a schematic (section) view of a further mass spectrometry arrangement incorporating an ion deflector arranged in accordance with an embodiment of the present invention.

FIG. 12 shows a mass spectrometry arrangement where two thermalisation devices 305 are placed in series following receipt of ions through gas curtain 220.

Figure 13:
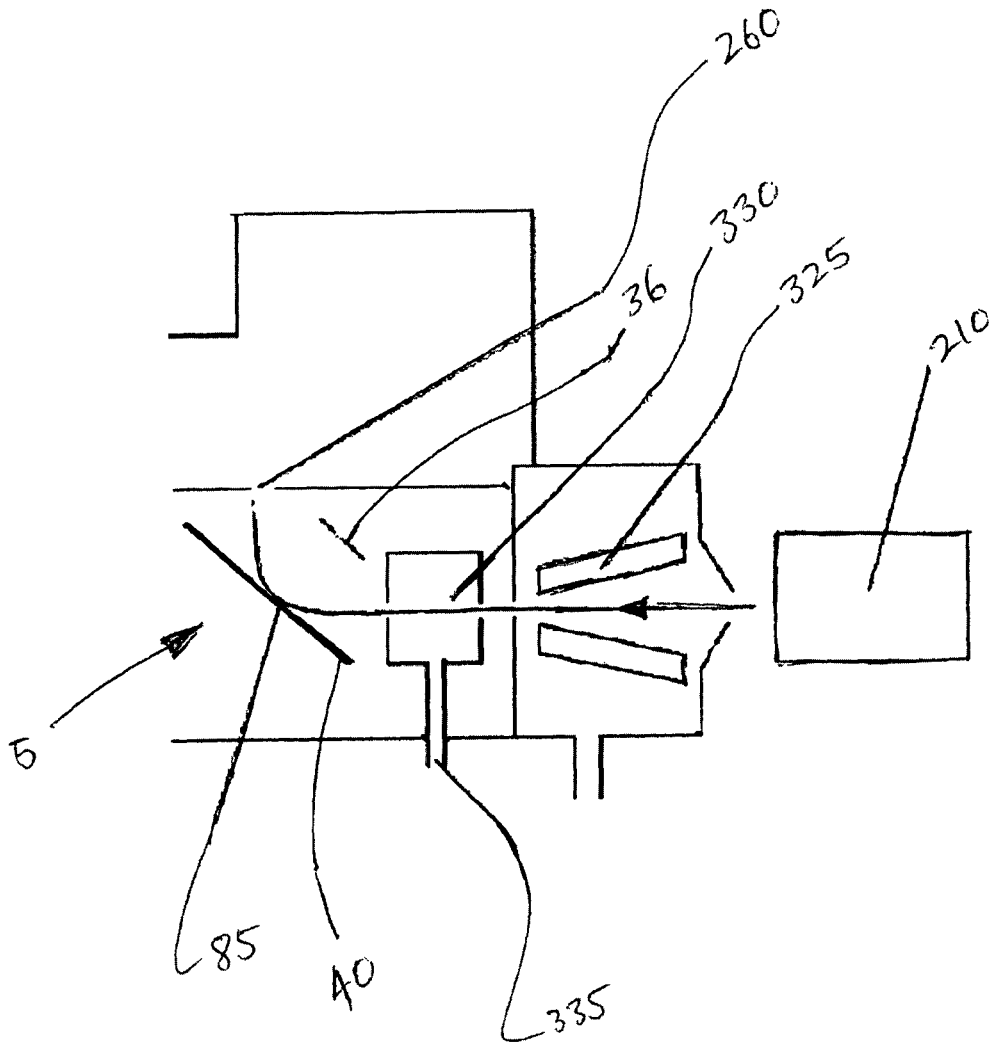
FIG. 13 shows a schematic (section) view of a further mass spectrometry arrangement incorporating an ion deflector arranged in accordance with an embodiment of the present invention.
Figure 14:
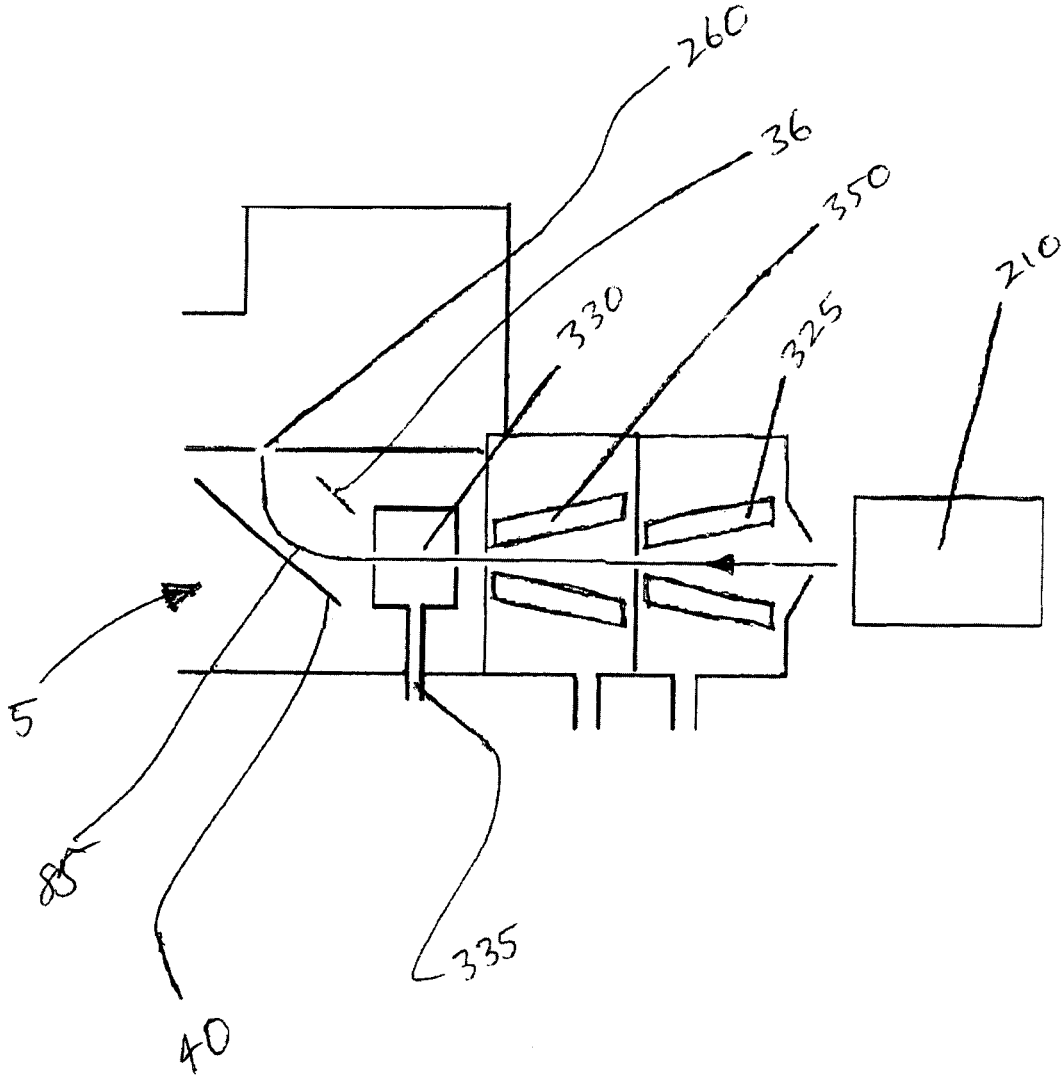
FIG. 14 shows a schematic (section) view of a further mass spectrometry arrangement incorporating an ion deflector arranged in accordance with an embodiment of the present invention.

FIG. 13 shows a mass spectrometry arrangement in which the thermalisation arrangement is configured with shaved or tapered guide elements 325, 350, and FIG. 14 shows the case where a series arrangement of two such thermalisation configurations is incorporated.

Figure 15:
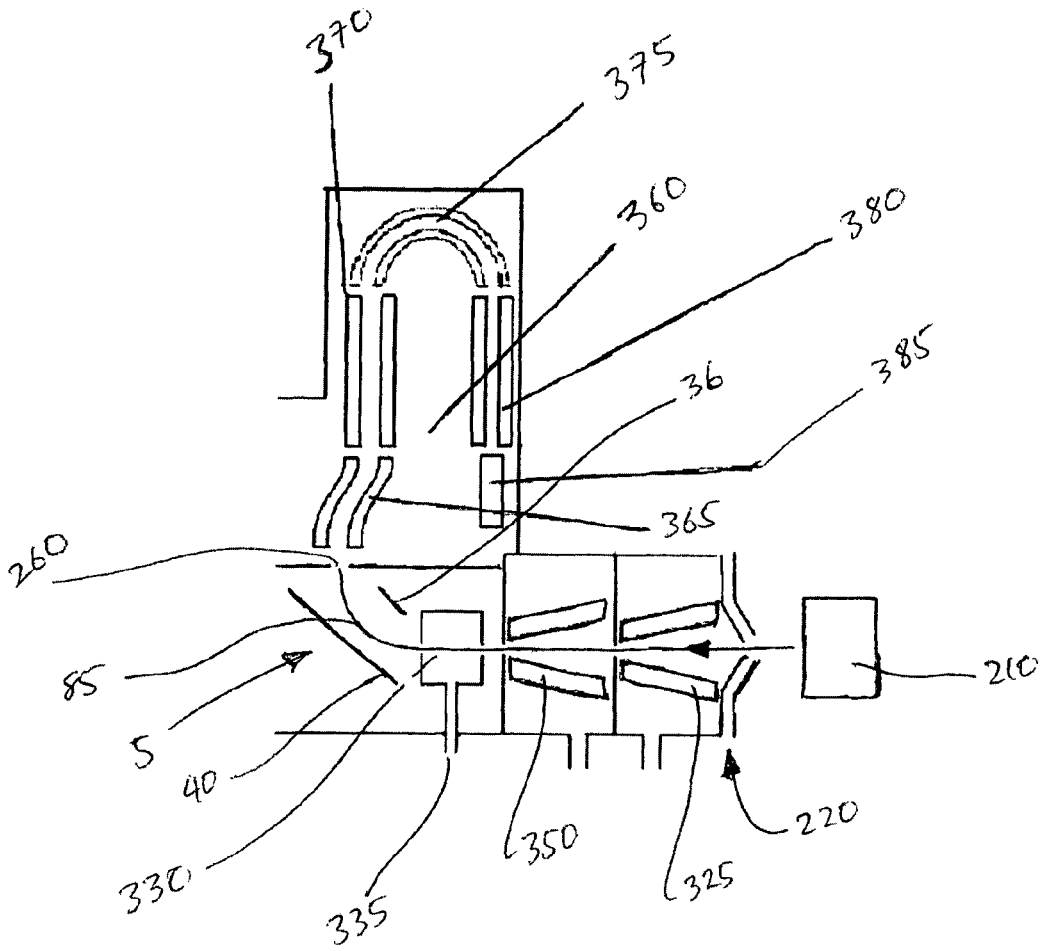
FIG. 15 shows a schematic (section) view of a further mass spectrometry arrangement incorporating an ion deflector arranged in accordance with an embodiment of the present invention.
Figure 16:
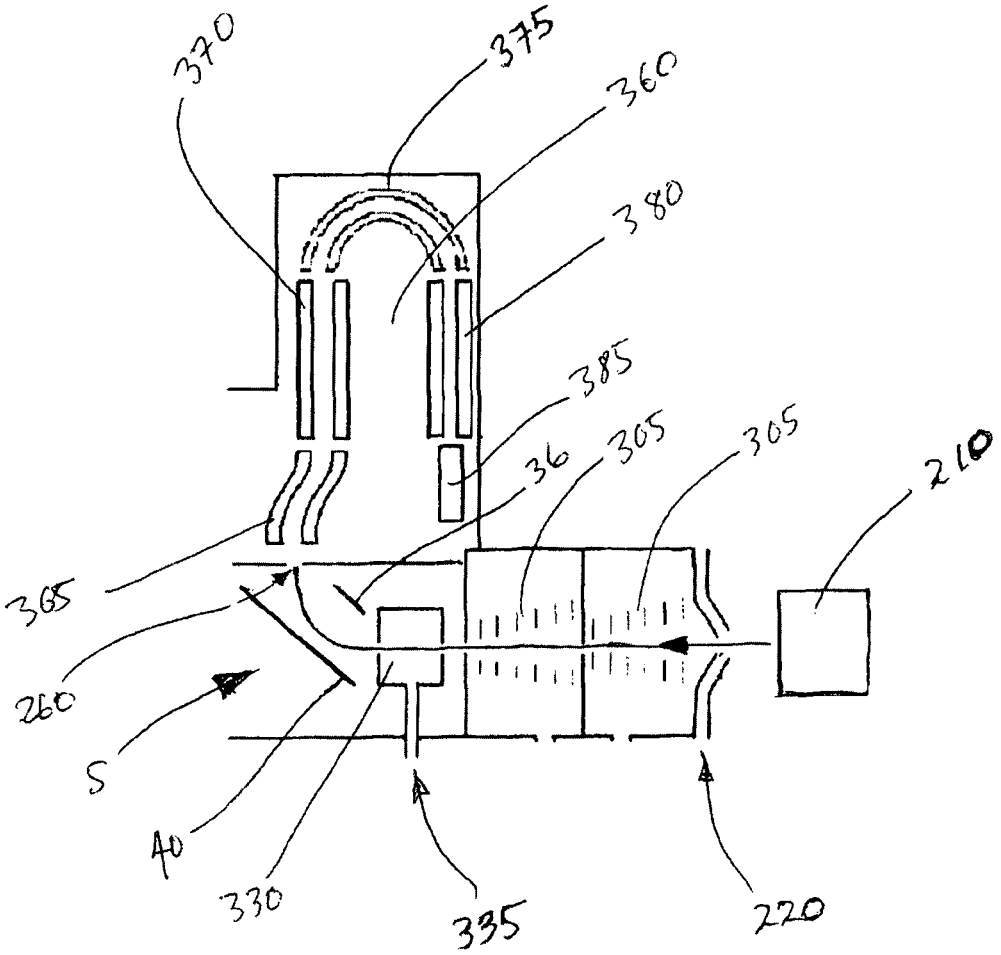
FIG. 16 shows a schematic (section) view of a further mass spectrometry arrangement incorporating an ion deflector arranged in accordance with an embodiment of the present invention.

It will be appreciated that additional mass filter arrangements may be used to further refine the ion beam once it has been deflected by the ion deflector 5. FIGS. 15 and 16 each show a mass spectrometry arrangement employing previously shown versions of the thermalisation arrangement downstream of the gas curtain 220. The ion beam is however deflected to the entrance of a triple quadrupole mass analyser arrangement 360. The mass-analyser arrangement 360 comprises a pre-filter arrangement 365 comprising an assembly of curved fringing rods which guides the ion beam toward a first quadrupole mass analyser 370. The ion beam is then passed into collisional cell 375 before entering a second quadrupole mass-analyser 380 which then guides the ion beam ultimately to the ion detector unit 385.

The skilled person will appreciate that the arrangements shown in FIGS. 7 to 16 are not intended to be exhaustive but merely serve to demonstrate how the principles of the ion deflector of the present invention may be readily deployed in different mass spectrometry arrangements. Other variations will be readily apparent to those skilled in the art.

The word 'comprising' and forms of the word 'comprising' as used in this description and in the claims does not limit the invention claimed to exclude any variants or additions.

The claims defining the invention are as follows:

1. An ion deflector for modifying the path of travel of a beam of ions in a mass spectrometer, the deflector including an electric field inducer arranged so as to establish more than one electrostatic field capable of deflecting ions travelling substantially along a first intended path of travel so as to travel substantially along a second intended path of travel, the ion deflector comprising a deflection element arranged in such a manner so as to be positioned on or around the first intended path of travel so that the ions travel towards the deflection element before being deflected, wherein the deflection element is arranged with a voltage source so as to be capable of providing said deflection element with a required/desired bias voltage potential, if any, the electric field inducer comprising a chargeable component which includes more than one chargeable element, the chargeable component being positioned in generally opposed relation to the deflection element and spaced apart from both the first and second intended paths of travel, wherein each of the chargeable elements is arranged with a voltage source so that they each exhibit either a positive or negative bias voltage potential such that the beam of ions flows about a circumferential portion of the chargeable component through a space between the deflection element and the chargeable component.

2. An ion deflector according to claim 1, wherein each chargeable element represents a segment of the chargeable component.

3. An ion deflector according to claim 1, wherein for the case when a chargeable element is provided with a bias voltage potential, the electric field produced is an electric monopole field in which the direction of the electric field lines depends on whether the bias voltage potential applied is positive or negative.

4. An ion deflector according to claim 1, wherein the electric field inducer is arranged so as to establish more than one electric monopole field.

5. An ion deflector according to claim 1, wherein each of the chargeable elements is provided with a substantially negative bias voltage potential relative to the potential of the ions entering the mass spectrometer.

6. An ion deflector according to claim 1, wherein the first and second intended paths travel of the ions reside within the same plane, or plane of flow.

7. An ion deflector according to claim 1, wherein the chargeable component comprises four chargeable elements, each arranged such that they are provided with a substantially negative bias voltage potential relative to the voltage potential when measured at the ion source.

8. An ion deflector according to claim 7, wherein the chargeable elements are operably arranged in pairs, with each half of the pair configured to oppose the other.

9. An ion deflector according to claim 8, wherein one of the operable pairs is arranged so that the applied bias voltage differential across the constituent chargeable elements is variable by a nominated or predetermined amount.

10. An ion deflector according to claim 9, wherein the chargeable components of each chargeable element pair are arranged relative to one another so that their geometrical arrangement is configured relative to the flow of the ion beam, so as to give effect to the desired direction of manipulation of the ion beam when the voltage differential is applied.

11. An ion deflector according to claim 7, wherein the chargeable component is circular and comprises four equally shaped chargeable elements.

12. An ion deflector according to claim 7, wherein the chargeable component is provided in the form of a substantially conical shape, or portion thereof.

13. An ion deflector according to claim 1, wherein the chargeable component is sufficiently positioned relative to the beam of ions so as to create an electric field capable of deflecting the ion beam in a predetermined manner.

14. An ion deflector according to claim 1, wherein the deflection element is grounded.

15. An ion deflector according to claim 14, wherein the circumferential shape of the deflection element is substantially segmented.

16. An ion deflector according to claim 14, wherein the deflection element is substantially curvilinear.

17. An ion deflector according to claim 1, wherein the electric field inducer is arranged so that the ions are deflected between first and second intended paths of travel when the axes are aligned at substantially 90 degrees to one another.

18. An ion deflector according to claim 1, wherein the electric field inducer is arranged so as to establish more than one electrostatic field capable of causing a flow of ions flowing along the first intended path of travel to flow toward a spatial region of intended focus so that one of (i) the spatial distribution of the ions flowing through the spatial region of intended focus is substantially reduced, and (ii) the ionic flux of the ions flowing through the spatial region is substantially greater, relative to that of the ions entering the mass spectrometer, respectively.

19. An ion deflector according to claim 18, wherein the electric field inducer is arranged so as to establish more than one electrostatic monopole field, the superposition of which is capable of allowing the ions to be selectively steered within three-dimensional space as required.

20. A method for modifying the path of travel of a beam of ions in a mass spectrometer, the method including the step of establishing more than one electrostatic field by means of an electric field inducer, capable of deflecting ions travelling substantially along a first intended path of travel to flow along a second intended path of travel for spectrometric analysis, providing a deflection element arranged in such a manner so as to be positioned on or around the first intended path of travel so that the ions travel towards the deflection element before being deflected, wherein the deflection element is arranged with a voltage source so as to provide said deflection element with a required/desired bias voltage potential, if any, the electric field inducer further comprising a chargeable component which includes more than one chargeable element, the chargeable component being positioned in generally opposed relation to the deflection element and spaced apart from both the first and second intended paths of travel, wherein each of the chargeable elements is arranged with a voltage source so that they each exhibit either a positive or negative bias voltage potential such that the beam of ions flows about a circumferential portion of the chargeable component through a space between the deflection element and the chargeable component.

* * * * *